United States Patent [19]

Douglas

[11] 4,218,047

[45] Aug. 19, 1980

[54] JOINTURE APPARATUS FOR TENNIS SCREEN STRUCTURES

[75] Inventor: Gerald A. Douglas, Bettendorf, Iowa

[73] Assignee: Douglas Industries, Inc., Eldridge, Iowa

[21] Appl. No.: 959,968

[22] Filed: Nov. 13, 1978

[51] Int. Cl.[2] ..... E04H 17/00; A63B 61/00

[52] U.S. Cl. ..... 256/1; 24/207; 403/331

[58] Field of Search ..... 24/201 C, 207, 230 BC; 160/235; 405/70, 71; 256/26, 24, 1, 23; 403/331

[56] References Cited

U.S. PATENT DOCUMENTS

| | | | |
|---|---|---|---|
| 2,491,524 | 12/1949 | Siple | 24/207 |
| 3,875,623 | 4/1975 | Johnston | 24/207 |
| 4,014,521 | 3/1977 | Berman | 256/1 |

FOREIGN PATENT DOCUMENTS

| | | | |
|---|---|---|---|
| 708324 | 5/1954 | United Kingdom | 24/230 BC |

*Primary Examiner*—Andrew V. Kundrat

*Attorney, Agent, or Firm*—Henderson & Sturm

[57] ABSTRACT

This invention relates to structures employed to support tennis screen structures. Provision of a screen structure which is more readily and accurately manufactured and installed, easier to repair or replace, and adaptable to various standard heights, to the wide variety of tennis court complex dimensions, and to a variety of strength requirements, is achieved by the invention. A jointure apparatus includes a member (17) with attachment and flap portions (18,21), screen structure being secured between the flaps (21). Another member (22) has at least one hollow cylindrical member (24) for receiving portion (18). A member (31) has a hollow cylindrical member (32) for receiving portion (18) and flap members (36) for receiving screen structure therebetween.

3 Claims, 6 Drawing Figures

FIG. 2
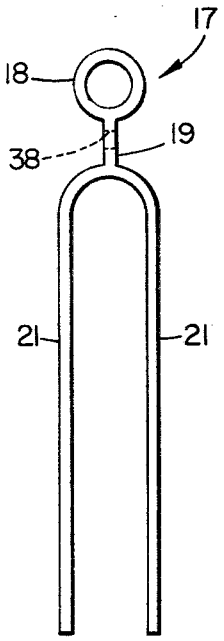
FIG. 3
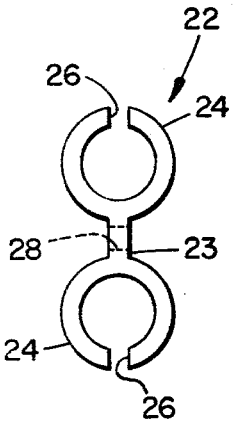
FIG. 4
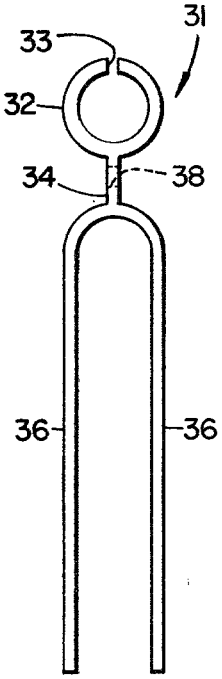
FIG. 5
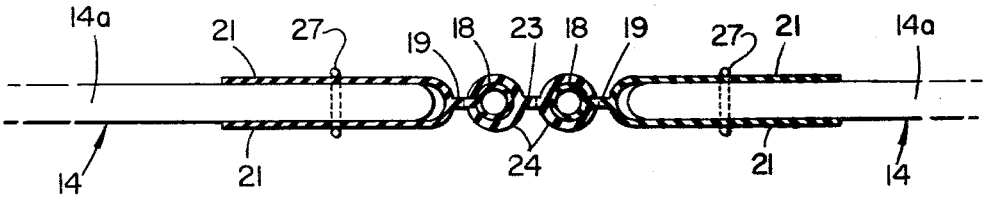
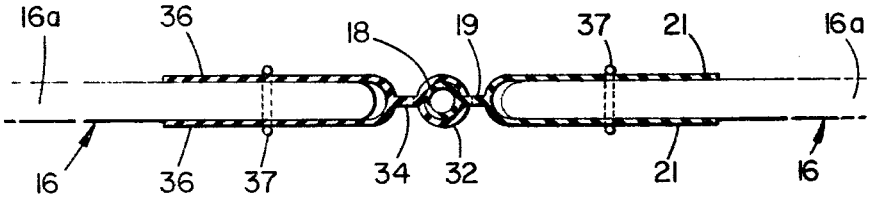
FIG. 6

JOINTURE APPARATUS FOR TENNIS SCREEN STRUCTURES

DESCRIPTION

Technical Field and Background Art

This invention relates primarily to tennis equipment such as windscreens, divider nets and like screen structures, employed for enclosing and protecting tennis courts. More particularly, this invention is concerned with joining together windscreens, divider nets or the like.

In the tennis industry, windscreens, divider nets and the like generally are customized. Although there are some generally accepted heights, each screen structure is manufactured in a length suited to the particular tennis court or complex of courts. Construction of court complexes is generally seasonal, and the manufacturer of screens usually is rushed to make and install the screens. This results frequently in errors in screen length which are costly to rectify. Furthermore, repair of a screen requires transporting of the entire screen, and replacement requires a complete new screen, both expensive propositions.

DISCLOSURE OF THE INVENTION

The tennis structures jointure apparatus of this invention includes a plurality of longitudinally elongated members. A first such member includes flaps between which screen structure is secured, and attached to the juncture of the flaps is a cylindrical portion. A second such member includes at least one hollow cylindrical portion for slidably receiving the cylindrical portion of the first such member, and the hollow portion is joined to another, similar, portion or to the juncture of other flaps, between which flaps screen structure is secured.

It is an object of this invention to provide a jointure apparatus for tennis screen structures which is readily adaptable to standardized screen heights.

It is also an object of this invention to provide a jointure apparatus which enables provision of tennis screen structures in standard length portions.

Another object of this invention is to provide a jointure apparatus such that tennis screen structures may be constructed and installed swiftly and more accurately, notwithstanding the variable dimensions of tennis court complexes.

It is also an object of this invention to provide a jointure apparatus readily adaptable to variable strength requirements.

Still another object of this invention is provision of a jointure apparatus such that tennis screen structures may be more readily repaired or replaced and in a more economical fashion.

A further object of this invention is provision of a jointure apparatus such that the aforementioned objects are attained and manufacture and construction of tennis screen structures nevertheless is rendered more economical.

These objects and other features and advantages of the jointure apparatus, for tennis screen structures, of this invention will become readily apparent upon referring to the following description, when taken in conjunction with the appended drawings.

BRIEF DESCRIPTION OF DRAWINGS

The jointure apparatus, for tennis screen structures, of this invention is illustrated in the drawings wherein:

FIG. 2 is an enlarged, end elevational view of a first member of the jointure apparatus;

FIG. 3 is an enlarged, end elevational view of a second member of the jointure apparatus;

FIG. 4 is an enlarged, end elevational view of a modified member of the jointure apparatus;

FIG. 5 is an enlarged, fragmentary, transverse sectional view taken along line 5—5 in FIG. 1 showing securement of a windscreen structure; and FIG. 6 is an enlarged, fragmentary, transverse sectional view taken along line 6—6 in FIG. 1 showing securement of a divider net structure.

BEST MODE FOR CARRYING OUT THE INVENTION

Figure 1:
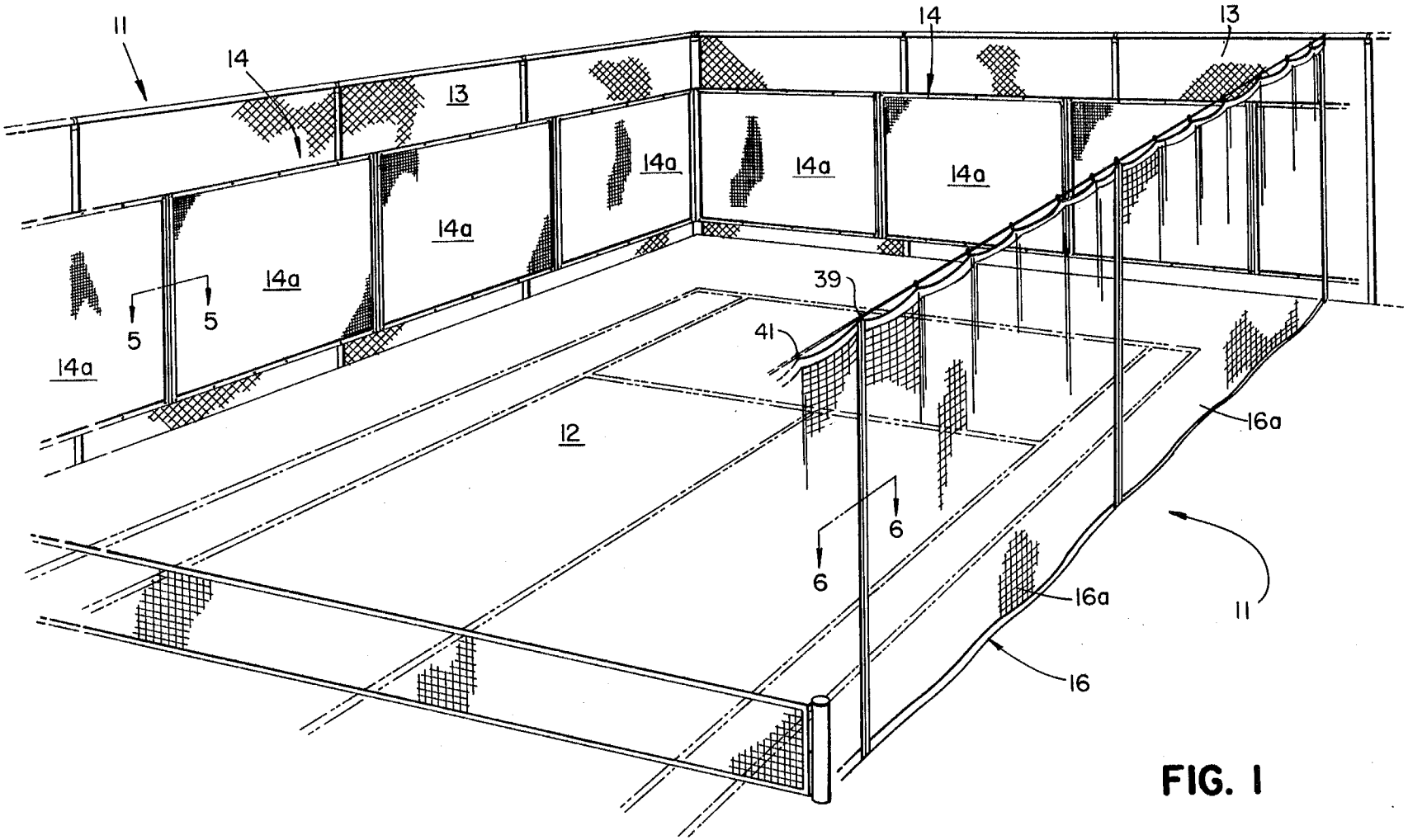
FIG. 1 is a perspective view showing employment of the invention in a tennis court complex.

The jointure apparatus for tennis screen structures is shown generally at 11 in FIG. 1 employed at a tennis court complex 12 enclosed by a screen wall 13. The jointure apparatus 11 is shown employed with a windscreen 14 and a divider net 16.

Referring more particularly to FIG. 2, the jointure apparatus 11 includes a longitudinally elongated first member 17. The member 17 includes a hollow, open-ended, cylindrical portion 18. A web portion 19 joins the portion 18 to the juncture of two flap portions 21.

Referring now to FIG. 3, the jointure apparatus 11 also includes a second longitudinally elongated member 22. This member 22 includes a central web 23 which interconnects opposed, hollow, open-ended cylindrical members 24. Longitudinal slits 26 are formed in both of the members 24, each slit 26 communicating with the hollow interior of the member 24 and being disposed opposite the juncture of web 23 and member 24.

As shown in FIGS. 1 and 5, the first and second members 17, 22 are disposed in a generally upright position. Portions 18 of members 17 are slidably received within portions 24 of member 22. The webs 19 extend through slits 26. The flaps 21 extend around, and are juxtapositioned against, windscreen portions 14*a*. The windscreen 14 is secured between flaps 21 as by stitching 27. Holes 28 (FIG. 3) with grommets are formed in webs 23 adjacent the upper and lower ends of the members 22, and holes 38 (FIG. 2) are similarly formed in members 17. Ties are passed through the holes 28, 38 and secure the windscreen structure 14 to the fence 13.

Referring to FIG. 4, the jointure apparatus 11 further includes modified longitudinally elongated member 31. The member 31 includes an open-ended, hollow cylindrical portion 32. A longitudinal slit 33 is formed in the portion 32 and communicates with the hollow interior thereof. A web portion 34 is attached to the portion 32 opposite the slit 33 and connects portion 32 to the juncture of two flap portions 36.

As shown in FIGS. 1 and 6, the members 17 and 31 are disposed in a generally vertical position. The portions 18 of members 17 are slidably received within portions 32 of members 31. The webs 19 extend through slits 33. The flaps 21, 36 extend to each side of, and are juxtapositioned against, divider net portions 16*a*. The divider net 16 is secured between flaps 21, 36 as by stitching 37. Holes 38 (FIGS. 2 and 4) with grommets are formed through webs 19, 34 adjacent both the upper and the lower ends of members 17, 31. Hooks 39, suspended from overhead wire 41, pass through the holes 38 to support the divider net structure 16.

The members 17, 22, 31 are constructed of suitable plastics and manufactured by extrusion processes well known in the art. The member 17 is preferably composed of a relatively flexible polyvinyl chloride and the member 22 of a relatively rigid polyvinyl chloride. The member 31 is preferably constructed of a flexible polyethylene or polypropylene. Standard screen heights in the tennis industry are 6 feet and 9 feet (about 1.8 m and 2.7 m respectively), and the members 22 may be made and employed in 3 or 4.5 foot (about 0.9 m or 1.4 m) sections respectively for such applications.

When a tennis screen structure such as a windscreen 14 or a divider net 16 is to be constructed, the members 17, 31 are disposed along the vertical edges of the screen structure, the structure thereafter being disposed between flaps 21, 36 and sewn, as at 27, 37. The members 17 are then slidably connected to members 31, or the members 17 are slidably connected to members 22, which members 22 may be in a plurality of sections. Ties or hooks 39 then engage holes 28, 38 to fix the screen structure in place. When the screen structure may have to withstand relatively greater stresses, such as in a windscreen 14, the configuration of jointure apparatus 11 shown in FIG. 5 is preferred. When the screen structure will be subjected to lesser stresses, as in a divider net 16, the configuration shown in FIG. 6 is preferred.

Screen structures comprised of a plurality of sections 14*a*, 16*a* of a standard length, such as 10 feet (about 3.1 m) are contemplated. Standard pieces are rapidly and easily manufactured. The screen structures may be erected rapidly, as the greatest portion of the screen can be put up immediately without any type of measurement. Adaptation of the screen structure to the particular size of the tennis court complex 12 is effected by measurement and cutting of the last segment 14*a* or 16*a*, and greater accuracy is provided thereby. Also, manufacturing tolerances can be much smaller since shorter lengths are being made. Furthermore, repair and replacement is greatly facilitated as only damaged sections 14*a*, 16*a* need be transported for repair or replaced. Although a best mode has been disclosed herein, it is to be remembered that various modifications and alternate constructions can be made thereto without departing from the full scope of the invention, as defined in the appended claims.

I claim:

1. A jointure apparatus for use in supported tennis screen structures, said apparatus comprising:

at least one first means for holding screen structure being longitudinally elongated and having an attachment portion and a flap portion, said attachment portion including a cylindrical first bead portion and a first web strip attached to said first bead portion, said first web strip having a plurality of support receiving means formed therethrough, said flap portion being joined to said web strip, being U-shaped and including a pair of flaps, said flaps being connected at the juncture of said flap portion and said first web strip, the screen structure being secured between said flaps; and second means for holding screen structure being longitudinally elongated and having at least one grasping means, said grasping means including a cylindrical second bead portion, a second web strip attached to said second bead portion, a longitudinal slot formed into said second bead portion opposite said second web strip, and a plurality of second support receiving means formed through said second web strip, said first bead portion being received by said second bead portion, said first web strip projecting through said longitudinal slot.

2. A jointure apparatus as described in claim 1 and further wherein said second means includes a cylindrical third bead portion having a longitudinal second slot formed therein, said second web strip being attached to said third bead portion opposite said second slot.

3. A jointure apparatus as described in claim 1 and further wherein said second means includes a second flap portion which is U-shaped and has a connected pair of second flaps, said second web strip being attached to said second flap portion.

* * * * *